US005733855A

United States Patent [19]

Severns

[11] Patent Number: 5,733,855

[45] Date of Patent: Mar. 31, 1998

[54] DRYER-ADDED FABRIC TREATMENT ARTICLE OF MANUFACTURE CONTAINING ANTIOXIDANT AND SUNSCREEN COMPOUNDS FOR SUN FADE PROTECTION OF FABRICS

[75] Inventor: John Cort Severns, West Chester, Ohio

[73] Assignee: The Procter & Gamble Company, Cincinnati, Ohio

[21] Appl. No.: 570,276

[22] Filed: Dec. 11, 1995

Related U.S. Application Data

[62] Division of Ser. No. 280,424, Jul. 26, 1994, Pat. No. 5,474,691.

[51] Int. Cl.[6] ..... C11D 17/00

[52] U.S. Cl. ..... 510/295; 510/327; 510/332; 510/356; 510/360; 510/461; 510/505; 510/504; 510/520

[58] Field of Search ..... 510/295, 299, 510/327, 332, 356, 360, 461, 499, 505, 520, 528, 504

[56] References Cited

U.S. PATENT DOCUMENTS

| | | | |
|---|---|---|---|
| 3,338,833 | 8/1967 | Spivack et al. | 252/47.5 |
| 3,714,122 | 1/1973 | Kline | 260/62 |
| 3,780,102 | 12/1973 | Buyssat | 260/558 |
| 3,878,229 | 4/1975 | Strobel | 260/404.5 |
| 3,992,434 | 11/1976 | Oppelt et al. | 260/473 |
| 4,049,713 | 9/1977 | Spivack | 260/559 R |
| 4,066,610 | 1/1978 | Kiss et al. | 260/42.21 |
| 4,069,309 | 1/1978 | Ciaudelli et al. | 424/47 |
| 4,246,198 | 1/1981 | Rosenberger et al. | 564/158 |
| 4,629,682 | 12/1986 | Leppard et al. | 430/372 |
| 4,680,144 | 7/1987 | Conner | 260/501.15 |
| 4,785,107 | 11/1988 | Helwig et al. | 546/244 |
| 4,876,084 | 10/1989 | Huri et al. | 424/62 |
| 4,931,471 | 6/1990 | Jury et al. | 514/622 |
| 5,134,223 | 7/1992 | Langer et al. | 528/272 |
| 5,143,729 | 9/1992 | Thompson | 424/402 |
| 5,194,667 | 3/1993 | Oxenrider et al. | 560/87 |
| 5,223,645 | 6/1993 | Barwich et al. | 564/158 |
| 5,243,021 | 9/1993 | Langer et al. | 528/272 |
| 5,250,652 | 10/1993 | Langer et al. | 528/125 |
| 5,298,647 | 3/1994 | Robert et al. | 360/16 |
| 5,340,827 | 8/1994 | Beeley et al. | 514/352 |
| 5,368,756 | 11/1994 | Vogel et al. | 252/8.8 |
| 5,374,362 | 12/1994 | McFarland | 252/8.6 |
| 5,376,287 | 12/1994 | Borcher, Sr. et al. | 252/8.8 |
| 5,474,691 | 12/1995 | Severns | 252/8.9 |
| 5,543,083 | 8/1996 | Sivik et al. | 252/403 |

FOREIGN PATENT DOCUMENTS

| | | |
|---|---|---|
| 0 165 710 A1 | 12/1985 | European Pat. Off. . |
| 0 196 282 | 10/1986 | European Pat. Off. . |
| 0 267 657 | 5/1988 | European Pat. Off. . |
| 0 272 576 A1 | 6/1988 | European Pat. Off. . |
| 0 273 011 A2 | 6/1988 | European Pat. Off. . |
| 0 374 751 A2 | 12/1988 | European Pat. Off. . |
| 0 374 751 A2 | 6/1990 | European Pat. Off. . |
| 0 523 955 A2 | 1/1993 | European Pat. Off. . |
| 0 523 956 A2 | 1/1993 | European Pat. Off. . |
| 2 081 716 | 2/1982 | United Kingdom . |
| 20597 | 9/1994 | WIPO . |

OTHER PUBLICATIONS

Polymer Degradation and Stability 10, "Ultraviolet Absorbers for Retarding Wool Photodegradation: Sulphonated 2-Hydroxybenzophenones and 2,2'-Dihydroxybenzophenones", (1985), pp. 335–352.

Cosmetics and Toiletries, "Encyclopedia of UV Absorbers for Sunscreen Products", vol. 107, Oct. 1992, pp. 45–64.

*Primary Examiner*—Christine Skane
*Assistant Examiner*—John R. Hardee
*Attorney, Agent, or Firm*—Robert B. Aylor

[57] ABSTRACT

The present invention relates to a dryer-added fabric treatment article of manufacturing to reduce the fading of fabrics from sunlight comprising:

I. a composition comprising:

A. from about 5% to about 75%, by weight of the composition, of a sun- fade protection active selected from the group consisting of:

i. a non-fabric staining, light stable, antioxidant compound preferably containing at least one $C_8$–$C_{22}$ hydrocarbon fatty organic moiety;

ii. a non-fabric staining, light stable, sunscreen compound; and iii. mixtures thereof;

B. from about 10% to about 95% by weight of the composition of a fabric conditioning compound; and II. a substrate, on which said composition is attached, which provides for release of an effective amount of said sun-fade protection active and said fabric conditioning compound onto fabrics in an automatic laundry dryer at automatic laundry dryer operating temperatures;

wherein said antioxidant compound is a solid having a melting point of less than about 80° C., or a liquid at a temperature of less than about 40° C.; and wherein said sunscreen compound absorbs light at a wavelength of from about 290 nm to about 450 nm and is a solid compound having a melting point of from about 25° C. to about 90° C., or a viscous liquid at a temperature of less than about 40° C.

27 Claims, No Drawings

DRYER-ADDED FABRIC TREATMENT ARTICLE OF MANUFACTURE CONTAINING ANTIOXIDANT AND SUNSCREEN COMPOUNDS FOR SUN FADE PROTECTION OF FABRICS

CROSS-REFERENCE TO RELATED APPLICATION

This application is a divisional of our application Ser. No. 08/280,424, filed Jul. 26, 1994 now U.S. Pat. No. 5,474,691.

TECHNICAL FIELD

The present invention relates to dryer-added fabric treatment article of manufacture comprising non-fabric staining, light stable antioxidant and sunscreen compounds to reduce the fading of fabrics from sunlight. The antioxidant compounds preferably contain at least one $C_8$–$C_{22}$ hydrocarbon fatty organic moiety, and are either a solid material having a melting point of less than about 80° C., or a liquid at a temperature of less than about 40° C. The sunscreen compounds absorb light at a wavelength of from about 290 nm to about 450 nm and are either a solid, having a melting point of from about 25° C. to about 90° C., or a viscous liquid at a temperature of less than about 40° C. Preferably, the articles of manufacture are dryer-sheets containing fabric conditioning compounds.

BACKGROUND OF THE INVENTION

Consumers worldwide experience color damage to their clothing from exposure to the sun during drying and during wear especially for those consumers living in tropical and subtropical climates. Despite extensive efforts by the textile industry to develop light stable dyes and after-treatments to improve light-fastness of dyes, the fading of clothing still remains a problem.

It has now been discovered that visible light is responsible for a significant amount of dye fading on clothing. For example, visible light has a higher contribution to light fading than UV-A, which has a higher contribution to light fading than UV-B.

Antioxidants provide a broad range of sun-fade fabric protection for the consumer because their effectiveness is not dependent upon the absorption of light. Because antioxidant agents are expensive, it is desirable to select and utilize the most efficient compounds in order to minimize the cost of the compositions.

As noted above, visible light is responsible for a significant amount of dye fading on clothing. Because the absorption spectrum of the sunscreen compounds of the present broadly absorbs UVA, these agents provide broader sun-fade protection with less problems than is associated with the conventional sunscreens.

The incorporation of sunscreens and antioxidants into fabric softeners and detergents for various benefits is known in the art. For example, U.S. Pat. No. 4,900,469, Clorox, teaches antioxidants in detergents for bleach stability. Antioxidants have been used in softeners and detergents to prevent fabric yellowing and to control malodor. (See, IP 72/116,783, Kao.) IP 63/162,798, Lion, teaches the use of sunscreens to stabilize the color of fabric conditioning compositions. U.S. Pat. No. 5,134,223, Langer et al., issued Jul. 28, 1992, Lever, teaches copolymers with a UV-absorbing monomer and a hydrophilic monomer to provide both anti-fading and soil release benefits. This reference teaches the combination of a polymer of UV-absorbing monomers to a soil release polymer consisting of a hydrophilic group (e.g. ethoxylate) and hydrophobic group (e.g. terephthalate blocks). U.S. Pat. No. 5,250,652, Langer et al., issued Oct. 5, 1993, Lever, teaches copolymers containing at least one UVA light-absorbing moiety and/or one UVB light-absorbing moiety, one low molecular weight (i.e., monomeric) hydrophilic moiety, and optionally one hydrophobic moiety for fabric care (detergents, fabric softeners, etc.) and skin care applications (cosmetics, shampoos, sunscreens, personal cleansing compositions, etc.). The use of low molecular weight hydrophilic moieties allows a loading of UVA and/or UVB moieties of up to about 95% and provides better dispersibility of the polymer in an aqueous media. The optional hydrophobic moiety provides control over the deposition of the copolymer on a desired surface.

All of the above patents and patent applications are incorporated herein by reference.

SUMMARY OF THE INVENTION

The present invention relates to a dryer-added fabric treatment article of manufacturing to reduce the fading of fabrics from sunlight comprising:

I. a composition comprising:

A. from about 5% to about 75%, by weight of the composition, of a sun- fade protection active selected from the group consisting of:

i. a non-fabric staining, light stable, antioxidant compound preferably containing at least one $C_8$–$C_{22}$ hydrocarbon fatty organic moiety;

ii. a non-fabric staining, light stable, sunscreen compound; and iii. mixtures thereof;

B. from about 10% to about 95% by weight of the composition of a fabric conditioning compound; and II. a substrate, on which said composition is attached, which provides for release of an effective amount of said sun-fade protection active and said fabric conditioning compound onto fabrics in an automatic laundry dryer at automatic laundry dryer operating temperatures;

wherein said antioxidant compound is a solid having a melting point of less than about 80° C., or a liquid at a temperature of less than about 40° C.; and wherein said sunscreen compound absorbs light at a wavelength of from about 290 nm to about 450 nm and is a solid compound having a melting point of from about 25° C. to about 90° C., or a viscous liquid at a temperature of less than about 40° C.

All percentages and ratios used herein are by weight of the total composition. All measurements made are at 25° C., unless otherwise designated. The invention herein can comprise, consist of, or consist essentially of, the essential as well as the optional ingredients and components described herein.

DETAILED DESCRIPTION OF THE INVENTION

The present invention relates to a dryer-added fabric treatment article of manufacture to reduce the fading of fabrics from sunlight comprising:

I. a composition comprising:

A. from about 5% to about 75%, by weight of the composition, of a sun- fade protection active selected from the group consisting of:

i. a non-fabric staining, light stable, antioxidant compound preferably containing at least one $C_8$–$C_{22}$ hydrocarbon fatty organic moiety;

ii. a non-fabric staining, light stable, sunscreen compound; and iii. mixtures thereof;

B. from about 10% to about 95% by weight of the composition of a fabric conditioning compound; and II. a substrate, on which said composition is attached, which provides for release of an effective amount of said sun-fade protection active and said fabric conditioning compound onto fabrics in an automatic laundry dryer at automatic laundry dryer operating temperatures;

wherein said antioxidant compound is a solid having a melting point of less than about 80° C., or a liquid at a temperature of less than about 40° C.; and wherein said sunscreen compound absorbs light at a wavelength of from about 290 nm to about 450 nm and is a solid compound having a melting point of from about 25° C. to about 90° C., or a viscous liquid at a temperature of less than about 40° C.

SUN-FADE PROTECTION ACTIVE

The present invention relates to a dryer-added fabric treatment article of manufacture to reduce the fading of fabrics from sunlight comprising a sun-fade protection active. Said sun-fade protection active is selected from the group consisting of a non-fabric staining, light stable antioxidant compound preferably containing at least one $C_8$–$C_{22}$ hydrocarbon fatty organic moiety, a non-fabric staining, light stable sunscreen compound, and mixtures thereof. Said sun-fade protection active is present at a level of from about 5% to about 75%, preferably from about 15% to about 60%, more preferably from about 25% to about 50%, by weight of the total composition.

It has been discovered that there is a distinct advantage to using an article of manufacture, i.e., a dryer sheet, over a rinse added medium to deliver the sun-fade protection active to the fabric. Even when the amount of sun-fade protection active delivered to fabrics from a dryer sheet is about ¼ to about ⅕ of that delivered from a rinse added medium, an excellent benefit is achieved. Not to be limited by theory, it is believed that the dryer sheet deposits the sun-fade protection active primarily on the surface of the fabric instead of allowing the sun-fade protection active to penetrate the fabric like a rinse. This enables a smaller amount of sun-fade protection active incorporated onto a dryer sheet to still provide excellent sun-fade protection benefits.

(A) ANTIOXIDANT ACTIVE

The antioxidant active of the present invention is a non-fabric staining, light stable antioxidant compound preferably containing at least one $C_8$–$C_{22}$ hydrocarbon fatty organic moiety, preferably at least one $C_{12}$–$C_{18}$ hydrocarbon fatty organic moiety; wherein the antioxidant compound is a solid having a melting point of less than about 80° C., preferably less than about 50° C., or a liquid at a temperature of less than about 40° C., preferably from about 0° C. to about 25° C.

Preferably, these antioxidant compounds are selected from the group consisting of:

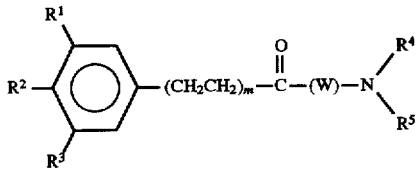

(I)

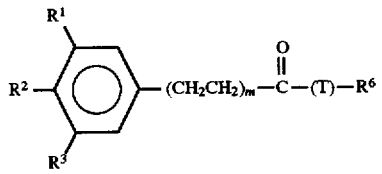

(II)

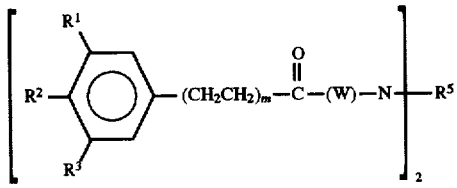

(III)

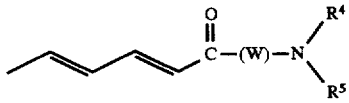

(IV)

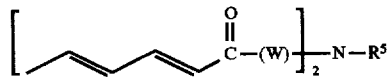

(V)

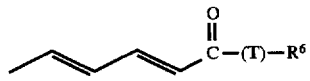

(VI)

and mixtures thereof (VII);

wherein each $R^1$ and $R^3$ are the same or different moiety selected from the group consisting of hydroxy, $C_1$ to $C_6$ alkoxy groups (i.e., methoxy, ethoxy, propoxy, butoxy groups), branched or straight chained $C_1$ to $C_6$ alkyl groups, and mixtures thereof, preferably branched $C_1$ to $C_6$ alkyl groups, more preferably "tert"-butyl groups;

each $R^2$ is a hydroxy group;

each $R^4$ is a saturated or unsaturated $C_1$ to $C_{22}$ alkyl group or hydrogen, preferably a methyl group;

each $R^5$ is a saturated or unsaturated $C_1$ to $C_{22}$ alkyl group which can contain one or more ethoxylate or propoxylate groups, preferably a saturated or unsaturated $C_8$ to $C_{22}$ alkyl group, more preferably a saturated or unsaturated $C_{12}$ to $C_{18}$ alkyl group, and even more preferably a saturated or unsaturated $C_{12}$ to $C_{14}$ alkyl group;

each $R^6$ is a branched or straight chained, saturated or unsaturated, $C_8$ to $C_{22}$ alkyl group, preferably a branched or straight chained, saturated or unsaturated $C_{12}$ to $C_{18}$ alkyl group, more preferably a branched or straight chained, saturated or unsaturated $C_{16}$ to $C_{18}$ alkyl group;

each T is

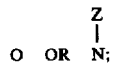

each W is $$(OCH\overset{Y}{\overset{|}{C}}H_2)_m \quad \text{OR} \quad N\overset{Z}{\overset{|}{-}}(CH_2)_q;$$

wherein Y is a hydrogen, a $C_1$ to $C_5$ alkyl group, preferably hydrogen or a methyl group, more preferably hydrogen;

wherein Z is hydrogen, a $C_1$ to $C_3$ alkyl group (which can be interrupted by an ester, amide, or ether group), a $C_1$ to $C_{30}$ alkoxy group (which can be interrupted by an ester, amide, or ether group), preferably hydrogen or a $C_1$ to $C_6$ alkyl group;

each m is from 0 to 4, preferably from 0 to 2;

each n is from 1 to 50, preferably from 1 to 10, more preferably 1; and each q is from 1 to 10, preferably from 2 to 6.

The antioxidants of the present invention can also comprise quaternary ammonium salts of Formulas I, III, IV and V, although amines of Formulas I, III, IV and V are preferred.

The antioxidant compounds of the present invention preferably comprise amine compounds of Formulas I, II, III, and mixtures thereof.

A preferred compound of Formula (II) is Octadecyl 3,5-di-tert-butyl-4-hydroxyhydrocinnamate, known under the trade name of Irganox® 1076 available from Ciba-Geigy Co.

A preferred compound of formula (III) is N,N-bis[ethyl 3',5'-di-tert-butyl-4'-hydroxybenzoate]N-cocoamine.

The preferred antioxidants of the present invention include 2-(N-methyl-N-coco-amino)ethyl 3',5'-di-tert-butyl-4'-hydroxybenzoate; 2-(N,N-dimethylamino)ethyl 3',5'-di-tert-butyl-4'-hydroxybenzoate; 2-(N-methyl-N-cocoamino) ethyl 3',4',5'-trihydroxybenzoate; and mixtures thereof, more preferably 2-(N-methyl-N-coco-amino)ethyl 3',5'-di-tert-butyl-4'-hydroxybenzoate. Of these compounds, the butylated compounds are preferred because the non-butylated compounds have a tendency to discolor in the composition of the present invention.

The antioxidant compounds of the present invention demonstrate light stability in the compositions of the present invention. "Light stable" means that the antioxidant compounds in the compositions of the present invention do not discolor when exposed to either sunlight or simulated sunlight for approximately 2 to 60 hours at a temperature of from about 25° C. to about 45° C.

Antioxidant compounds and free radical scavengers can generally protect dyes from degradation by first preventing the generation of singlet oxygen and peroxy radicals, and thereafter terminating the degradation pathways. Not to be limited by theory, a general discussion of the mode of action for antioxidants and free radical scavengers is disclosed in Kirk Othmer, The Encyclopedia of Chemical Technology, Volume 3, pages 128–148, which is incorporated herein by reference in its entirety.

Treatment of fabric with articles of manufacture of the present invention repeatedly during drying in an automatic laundry dryer can result in higher deposition levels, which contributes even further to the sun-fading benefit.

Coventional sunscreens are generally less suitable for application to fabric because they less effectively deposit on surfaces, they sometimes discolor fabrics, they are not always stable or compatible with other components in the composition, and they are often expensive.

Preferred sunscreen compounds and methods of making them are disclosed in P&G copending application Ser. No. 08/280,692, now U.S. Pat. No. 5,705,474, Sivik and Severns, filed on Jul. 26, 1994, which is herein incorporated by reference.

(B) SUNSCREEN ACTIVES

The present invention can comprise from about 5% to about 75%, preferably from about 15% to about 60%, more preferably from about 25% to about 50%, by weight of the composition, of a non-fabric staining, light stable sunscreen compound, wherein the sunscreen compound absorbs light at a wavelength of from about 290 nm to about 450 nm; wherein the sunscreen compound is a solid having a melting point of from about 25° C. to about 90° C. or a viscous liquid at a temperature of less than about 40° C.

Preferably, the sunscreen compound comprises at least one $C_8$ to $C_{22}$ hydrocarbon fatty organic moiety, more preferably at least one $C_{12}$ to $C_{18}$ hydrocarbon fatty organic moiety. Preferably the sunscreen absorbs light at a wavelength of from about 315 nm to about 400 nm and is a solid having a melting point of from about 25° C. to about 75° C., more preferably from about 25° C. to about 50° C., or a viscous liquid at a temperature of from 0° C. to about 25° C.

Preferably these sunscreen compounds contain at least one chromophore selected from the group consisting of:

(I)

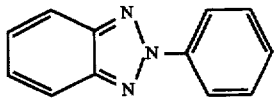

Phenylbenzotriazole (II)

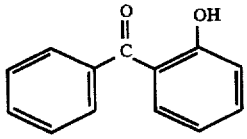

2-Hydroxybenzophenone (III)

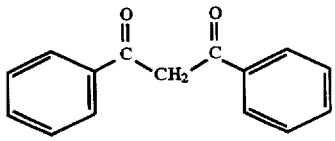

Dibenzoylmethane (IV)

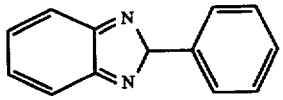

Phenylbenzimidazole (V)

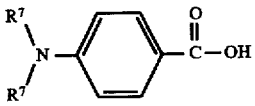

Esters of P-Aminobenzoic Acid (PABA)

(VI)

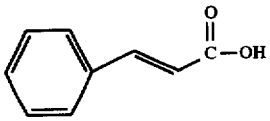

Esters of Cinnamic Acid

-continued (VII)

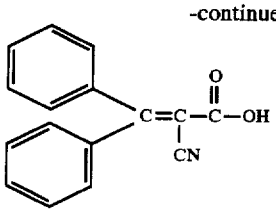

Esters of 2-Cyano-3, 3-Diphenyl-2-Propenoic Acid (VIII)

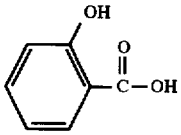

Esters of Salicylic Acid and mixtures thereof; (IX)

wherein $R^7$ is a hydrogen, methyl, ethyl, $C_1$ to $C_{22}$ branched or straight chain alkyl group; and mixtures thereof, preferably a methyl group; and wherein the compound containing the chromophore is a non-fabric staining, light stable compound containing preferably at least one $C_8$–$C_{22}$ hydrocarbon fatty organic moiety; wherein the chromophore absorbs light at a wavelength of from about 290 nm to about 450 nm; wherein the compound is a solid having a melting point of from about 25° C. to about 90° C. or a viscous liquid at a temperature of less than about 40° C.

Preferably the sunscreen compound containing at least one chromophore is selected from the group consisting of (I), (II), (III), (IV), (V), (VII), (VIII), and mixtures thereof; more preferably, the sunscreen compound containing at least one chromophore is selected from the group consisting of (I), (II), (III), (IV) and mixtures thereof, and even more preferably (I) and (II), and mixtures thereof. Furthermore, compounds containing at least one Formula (I) chromophore are especially preferred.

Most preferably, the sunscreen compound is selected from the group consisting of:

(I)

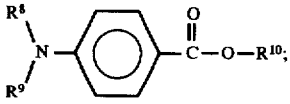

(II)

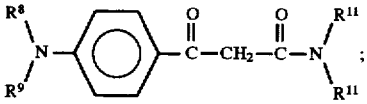

(III)

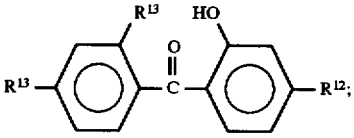

(IV)

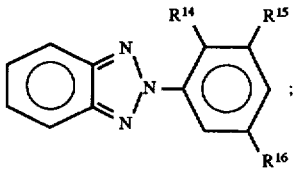

mixtures thereof; (V)

wherein each $R^8$ is a hydrogen or a $C_1$–$C_{22}$ alkyl group; preferably a hydrogen or a methyl group;

each $R^9$ is a hydrogen, or a $C_1$–$C_{22}$ alkyl group; preferably a hydrogen or a methyl group;

each $R^{10}$ is a $C_1$–$C_{22}$ alkyl group, preferably a $C_8$–$C_{18}$ alkyl group; more preferably a $C_{12}$–$C_{18}$ alkyl group;

each $R^{11}$ is a hydrogen, a $C_1$–$C_{22}$ alkyl group and mixtures thereof, preferably a methyl group, a $C_8$–$C_{22}$ alkyl group, and mixtures thereof, more preferably, one $R^{11}$ group is a $C_{10-C20}$ alkyl group, preferably a $C_{12}$–$C_{18}$ alkyl group, and the other $R^{11}$ group is a methyl group;

each $R^{12}$ is a hydrogen, hydroxy group, methoxy group, a $C_1$–$C_{22}$ alkyl group (which can be an ester, amide, or ether interrupted group) and mixtures thereof, preferably a $C_1$–$C_{22}$ alkyl group with an ether or ester interrupted group, and mixtures thereof, more preferably a methoxy group, a $C_8$–$C_{22}$ alkyl group with an ester interrupted group, and mixtures thereof;

each $R^{13}$ is a hydrogen, hydroxy group, a $C_1$–$C_{22}$ alkyl group (which can be an ester, amide, or ether interrupted group) and mixtures thereof, preferably a hydrogen, hydroxy group, and mixtures thereof, more preferably hydrogen;

each $R^{14}$ is a hydrogen, hydroxy group, or a $C_1$–$C_{22}$ alkyl group, preferably a hydrogen or a hydroxy group, more preferably a hydroxy group;

each $R^{15}$ is a hydrogen, hydroxy group, a $C_1$–$C_{22}$ alkyl group (which can be an ester, amide, or ether interrupted group), and mixtures thereof, preferably a $C_1$–$C_{12}$ alkyl group, more preferably a $C_1$–$C_8$ alkyl group, and even more preferably a methyl group, a "tert"-amyl group, or a dodecyl group;

each $R^{16}$ is a hydrogen, hydroxy group, or a $C_1$–$C_{22}$ alkyl group (which can be an ester, amide, or ether interrupted group), preferably a "tert"-amyl, a methyl phenyl group, or a coco dimethyl butanoate group.

The sunscreen compound of the present invention absorbs light at a wavelength of from about 290 nm to about 450 nm, preferably from about 315 nm to about 400 nm.

In the compositions of the present invention, $R^{12}$, $R^{13}$, $R^{14}$, $R^{15}$ and $R^{16}$ can be interrupted by the corresponding ester linkage interrupted group with a short alkylene ($C_1$–$C_4$) group.

The physical properties of the sunscreen compound effects both compatibility with the softener compound and efficacy (coverage) on the fabrics. Therefore, not all sunscreen agents provide activity. Derivatization of known sunscreen structures with a $C_8$–$C_{22}$ fatty hydrocarbon chain typically reduces the melting point of the sunscreen agent which allows better incorporation into the softener matrix and better deposition and performance on fabric.

Preferred sunscreen compounds of the present invention are selected from the group consisting of fatty derivatives of PABA, benzophenones, cinnamic acid and phenyl benzotriazoles, specifically, octyl dimethyl PABA, dimethyl PABA lauryl ester, dimethyl PABA oleyl ester, benzophenone-3 coco acetate ether, benzophenone-3 available under the tradename Spectra-Sorb® UV-9 from Cyanamid, 2-(2'-Hydroxy-3',5'-di-tert-amylphenyl benzotriazole which is available under the tradename Tinuvin® 328 from Ceiba-Geigy, Tinuvin® coco ester 2-(2'Hydroxy, 3'-(coco dimethyl butanoate)-5'-methylphenyl) benzotriazole, and mixtures thereof. Preferred sunscreen compounds of the present invention are benzotriazole derivatives since these materials absorb broadly throughout the UV region. Preferred benzotriazole derivatives are selected from the group consisting of 2-(2'-Hydroxy, 3'dodecyl, 5'-methylphenyl benzotriazole from Ciba-Geigy, available under the tradename Tinuvin® 571 Coco 3-[3'-(2H-benzotriazol-2"-yl)-5'-tert-butyl-4'-hydroxyphenyl] propionate.

The sunscreen compounds of the present invention demonstrate light stability in the compositions of the present invention. "Light stable" means that the sunscreen agents in the compositions of the present invention do not discolor when exposed to either sunlight or simulated sunlight for approximately 2 to 60 hours at a temperature of from about 25° C. to about 45° C.

(C) MIXTURES OF ANTIOXIDANT AND SUNSCREEN COMPOUNDS

The present composition can comprise a mixture of antioxidant compounds and sunscreen compounds. Combinations of the sun-fade protection actives are particularly desirable because they address different mechanisms. Whereas the antioxidant compound protects dye degradation by preventing the generation of singlet oxygen and peroxy radicals and terminating degradation pathways; the sunscreen compound broadly absorbs UVA light in order to protect against sun-fade. The combination of these two mechanisms allows for broad sun-fade protection. When a mixture is present, the ratio of antioxidant to sunscreen is typically from about 1:10 to about 10:1, preferably from about 1:5 to about 5:1, and more preferably from about 1:2 to about 2:1, wherein the total amount of antioxidant compound plus sunscreen compound is from about 5% to about 75%, preferably from about 15% to about 60%, more preferably about 25% to about 50%, by weight of total composition.

(D) FABRIC CONDITIONING COMPOUND

The present invention also contains a fabric conditioning compound at a level of from about 10% to about 95% by weight of the total composition, preferably from about 15% to about 85%, more preferably from about 25% to about 75% by weight of the composition. The fabric conditioning compound is selected to minimize any adverse interaction with the sunscreen and the antioxidant compound.

When mixtures of the fabric conditioning compound are used, each fabric conditioning active preferably is present at a level of from about 1% to about 95%, preferably from about 5% to about 50%, more preferably from about 5% to about 40% by weight of the total fabric conditioning compound. The fabric conditioning compound is selected from the group consisting of ester quaternary ammonium compounds, ethoxylated and/or propoxylated sugar derivatives, carboxylic acid salts of tertiary amines, and mixtures thereof.

1. Quaternary Ammonium Compound

Some preferred fabric conditioning active are ester quaternary ammonium compounds (EQA).

The quaternary ammonium compound of the present invention is selected from Formulas I, II, III, IV, and mixtures thereof. Formula I comprises:

$$[(R^{17})_{4-p}N^{+}-[(CH_2)_v-Y'-R^{18}]_p]X^{-}$$

wherein each Y'=—O—(O)C—, or —C(O)—O—;

each p=1 to 3;

each v=is an integer from 1 to 4;

each $R^{17}$ substituent is a short chain $C_1$–$C_6$, preferably $C_1$–$C_3$, alkyl group, e.g., methyl (most preferred), ethyl, propyl, and the like, benzyl group, and mixtures thereof;

each $R^{18}$ is a long chain, saturated and/or unsaturated (Iodine Value of from about 3 to about 60), $C_8$–$C_{30}$ hydrocarbyl, or substituted hydrocarbyl substituent, preferably $C_{12}$–$C_{18}$ hydrocarbyl or substituted hydrocarbyl substituent, and mixtures thereof; and the counterion, $X^-$, can be any softener-compatible anion, for example, methylsulfate, ethylsulfate, chloride, bromide, formate, sulfate, lactate, nitrate, benzoate, and the like, preferably methylsulfate.

It will be understood that substituents $R^{17}$ and $R^{18}$ of Formula I can optionally be substituted with various groups such as alkoxyl or hydroxyl groups. The preferred compounds can be considered to be diester variations of ditallow dimethyl ammonium methyl sulfate (DTDMAMS), which is a widely used fabric softener.

EQA compounds prepared with fully saturated acyl groups are rapidly biodegradable and excellent softeners. However, compounds prepared with at least partially unsaturated acyl groups have advantages (i.e., antistatic benefits) and are highly acceptable for consumer products when certain conditions are met.

Variables that must be adjusted to obtain the benefits of using unsaturated acyl groups include the Iodine Value (IV) of the fatty acids, the odor of fatty acid starting material, and/or the EQA. Any reference to Iodine Values hereinafter refers to Iodine Values of fatty acyl groups and not to the resulting EQA compound.

Antistatic effects are especially important where the fabrics are dried in a tumble dryer, and/or where synthetic materials which generate static are used. As the Iodine Value is raised, there is a potential for odor problems.

Some highly desirable, readily available sources of fatty acids such as tallow, possess odors that remain with the compound EQA despite the chemical and mechanical processing steps which convert the raw tallow to finished EQA. Such sources must be deodorized, e.g., by absorption, distillation (including stripping such as steam stripping), etc., as is well known in the art. In addition, care must be taken to minimize contact of the resulting fatty acyl groups to oxygen and/or bacteria by adding antioxidants, antibacterial agents, etc. The additional expense and effort associated with the unsaturated fatty acyl groups is justified by the superior performance.

Generally, hydrogenation of fatty acids to reduce polyunsaturation and to lower the Iodine Value to insure good color and odor stability leads to a high degree of trans configuration in the molecule. Therefore, diester compounds derived from fatty acyl groups having low Iodine Values can be made by mixing fully hydrogenated fatty add with touch hydrogenated fatty acid at a ratio which provides an Iodine Value of from about 3 to about 60. The polyunsaturation content of the touch hardened fatty acid should be less than about 5%, preferably less than about 1%. During touch hardening the cis/trans isomer weight ratios are controlled by methods known in the art such as by optimal mixing, using specific catalysts, providing high $H_2$ availability, etc.

The following are non-limiting examples of the quaternary ammonium compound of Formula I (wherein all long-chain alkyl substituents are straight-chain):

Saturated $[C_2H_5]_2 + N[CH_2CH_2OC(O)C_{17}H_{35}]_2(CH_3SO_4)^-$ $[HO-CH(CH_3)CH_2][CH_3]^+N[CH_2CH_2OC(O)C_{15}H_{31}]_2Br^-$ $[CH_3][C_2H_5]^+N[CH_2CH_2OC(O)C_{13}H_{27}]_2(HCOO)^-$ $[C_3H_7][C_2H_5]^+N[CH_2CH_2OC(O)C_{11}H_{23}]_2(CH_3SO_4)^-$ $[CH_3]_2{}^+N(CH_2CH_2OC(O)C_{15}H_{31})(CH_3SO_4)^-$
$\quad\quad | $
$\quad\quad CH_2CH_2OC(O)C_{17}H_{35}$ $[CH_3]_2{}^+N[CH_2CH_2OC(O)R^{18}]_2(CH_3SO_4)^-$ where $-C(O)R^{18}$ is derived from saturated tallow.

Unsaturated $[CH_3]_2{}^+N[CH_2CH_2OC(O)C_{17}H_{33}]_2(CH_3SO_4)^-$ $[HO-CH(CH_3)CH_2][CH_3]^+N[CH_2CH_2OC(O)C_{15}H_{29}]_2(HCOO)^-$ $[C_2H_5]_2{}^+N[CH_2CH_2OC(O)C_{17}H_{33}]_2Cl^-$ $[CH_3][C_2H_5]^+N[CH_2CH_2OC(O)C_{13}H_{25}]_2(C_6H_5COO)^-$ $[CH_3]_2{}^+N(CH_2CH_2OC(O)C_{15}H_{29})(CH_3CH_2SO_4)^-$
$\quad\quad | $
$\quad\quad CH_2CH_2OC(O)C_{17}H_{33}$ $[CH_2CH_2OH][CH_3]^+N[CH_2CH_2OC(O)R^{18}]_2(CH_3SO_4)^-$ $[CH_3]_2{}^+N[CH_2CH_2OC(O)R^{18}]_2(CH_3SO_4)^-$ where $-C(O)R^{18}$ is derived from partially hydrogenated tallow or modified tallow having the characteristics set forth herein.

In addition to Formula I compounds, the compositions and articles of the present invention can also comprise quaternary ammonium compounds of Formula II:

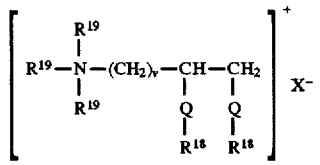

wherein, for any molecule:

each Q is

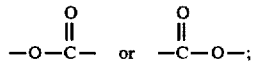

each $R^{19}$ is $C_1$–$C_4$ alkyl or hydroxy alkyl group;

each $R^{18}$, v, and $X^-$ are defined hereinbefore for Formula I; and wherein preferably $R^{19}$ is a methyl group, v is 1, Q is

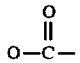

each $R^{18}$ is a $C_{14}$–$C_{18}$ alkyl group; and $X^-$ is methyl sulfate.

The straight or branched alkyl or alkenyl chains, $R^{18}$, have from about 8 to about 30 carbon atoms, preferably from about 14 to about 18 carbon atoms, more preferably straight chains having from about 14 to about 18 carbon atoms.

Tallow is a convenient and inexpensive source of long chain alkyl and alkenyl materials.

A specific example of a biodegradable Formula II compound suitable for use in the fabric conditioning compositions herein is: 1,2-bis(tallowyl oxy)-3-trimethyl ammoniopropane methylsulfate.

Other examples of suitable Formula II compounds of this invention are obtained by, e.g., replacing "tallowyl" in the above compounds with, for example, cocoyl, lauryl, oleyl, stearyl, palmityl, or the like;

replacing "methyl" in the above compounds with ethyl, propyl, isopropyl, butyl, isobutyl, t-butyl, or the hydroxy substituted analogs of these radicals;

replacing "methylsulfate" in the above compounds with chloride, ethylsulfate, bromide, formate, sulfate, lactate, nitrate, and the like, but methylsulfate is preferred.

The compounds herein can be prepared by standard esterification and quaternization reactions, using readily available starting materials. General methods for preparation are disclosed in U.S. Pat. No. 4,137,180, incorporated herein by reference.

In addition to Formula I and Formula II compounds, the compositions and articles of the present invention comprise quaternary ammonium compounds of Formula III:

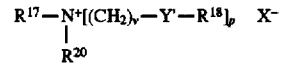

wherein $R^{20}$ is a short chain $C_1$–$C_4$ alcohol;

p is 2;

$R^{17}$, $R^{18}$ v, Y', and $X^-$ are as previously defined for Formula I.

A specific example of a biodegradable Formula III compound suitable for use in the fabric conditioning compositions herein is N-methyl-N,N-di-($C_{14}$–$C_{18}$-acyloxy ethyl), N-hydroxyethyl ammonium methylsulfate. A preferred compound is N-methyl, N,N-di-(2-oleyloxyethyl) N-2-hydroxyethyl ammonium methylsulfate.

Compositions of the present invention may also comprise Formula IV compounds:

$(R^{17})_{4-p}-N^+-[(CH_2)_v-Y''-R^{18}]_pX^-$ $R^{17}$, $R^{18}$, p, v, and $X^-$ are previously defined in Formula I; and

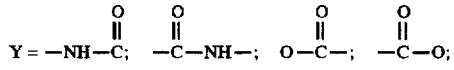

and mixtures thereof, wherein at least one Y" group is

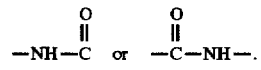

Compositions of the present invention can also comprise Formula V compounds:

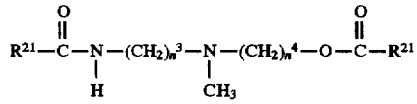

wherein each $R^{21}$ is independently, hydrocarbyl, preferably alkyl, groups containing from about 11 to about 31, preferably from about 13 to about 17 carbon atoms, more preferably straight chain alkyl groups;

each $n^3$ is from 1 to 5, preferably from 1 to 3; and each $n^4$ is from 1 to 5, preferably 2.

Compositions of the present invention may also comprise mixtures of formulas I to V.

Preferably, Component (A) of the present invention is a biodegradable quaternary ammonium compound.

2. Ethoxylated/Propoxylated Sugar Derivatives

A second type of fabric conditioning compound of the present invention is an ethoxylated and/or propoxylated sugar derivative.

The ethoxylated and/or propoxylated sugar derivative contains a "sugar" moiety, e.g., a moiety derived from, e.g., a polyhydroxy sugar, or sugar alcohol, that contains from about 4 to about 12 hydroxy groups. This sugar moiety is substituted by at least one long hydrophobic group, containing from about 8 to about 30 carbon atoms, preferably from about 16 to about 18 carbon atoms. For improved physical characteristics, e.g., higher melting point, the hydrophobic group can contain more carbon atoms, e.g., 20–22, and/or there can be more than one hydrophobic group, preferably two or, less preferably, three. In general, it is preferred that the hydrophobic group is supplied by esterifying one of the hydroxy groups with a fatty acid. However, the hydrophobic group can be supplied by esterifying the hydroxy group to connect the hydrophobic group to the sugar moiety by an ether linkage, and/or a moiety containing a carboxy group esterified with a fatty alcohol can be attached to the sugar moiety to provide the desired hydrophobic group.

Sugar moieties include sucrose, galactose, mannose, glucose, fructose, sorbitan, sorbitol, mannitol, inositol, etc., and/or their derivatives such as glucosides, galactosides, etc. Other "sugar" types of moieties containing multiple hydroxy groups can also be used including starch fractions and polymers such as polyglycerols. The sugar moiety is any polyhydroxy group that provides the requisite number of hydroxy groups.

The hydrophobic group can be provided by attachment with an ester, ether, or other linkage that provides a stable compound. The hydrophobic group is preferably primarily straight chain, and preferably contains some unsaturation to provide additional antistatic benefits. Such hydrophobic groups and their sources are well known, and are described hereinafter with respect to the more conventional types of softening agents.

The polyalkoxy chain can be all ethoxy groups, and/or can contain other groups such as propoxy, glyceryl ether, etc., groups. In general, polyethoxy groups are preferred, but for improved properties such as biodegradability, glyceryl ether groups can be inserted. Typically there are from about 5 to about 100, preferably from about 10 to about 40, more preferably from about 15 to about 30, ethoxy groups, or their equivalents, per molecule.

An empirical formula is as follows:

$$R_s^{22}(\text{sugar})(R^{23}O)_t$$

wherein $R^{22}$ is a hydrophobic group containing from about 8 to about 30, preferably from about 12 to about 22, more preferably from about 16 to about 18 carbon atoms; "sugar" refers to a polyhydroxy group, preferably derived from a sugar, sugar alcohol, or similar polyhydroxy compound; $R^{23}$ is an alkylene group, preferably ethylene or propylene, more preferably ethylene; s is a number from 1 to about 4, preferably 2; and t is a number from about 5 to about 100, preferably from about 10 to about 40. A preferred compound of this type is polyethoxylated sorbitan monostearate, e.g., Glycosperse® S-20 from Lonza, which contains about 20 ethoxylate moieties per molecule.

3. Carboxylic Acid Salt of a Tertiary Amine

A third type of fabric conditioning compound of the present invention is a carboxylic acid salt of a tertiary amine. The carboxylic acid salt of a tertiary amine has the formula:

$$[R^{24}\text{–}N\ (R^{25})(R^{26})\text{–}H]^{(+)(-)}[O\text{–}C(O)\text{–}R^{27}]$$

wherein $R^{24}$ is a long chain aliphatic group containing from about 8 to about 30 carbon atoms; $R^{25}$ and $R^{26}$ are the same or different from each other and are selected from the group consisting of aliphatic groups containing from about 1 to about 30 carbon atoms, hydroxyalkyl groups of the Formula $R^{28}OH$ wherein $R^{28}$ is an alkylene group of from about 2 to about 30 carbon atoms, and alkyl ether groups of the formula $R^{29}O(C_nH_{2n}O)_m$ wherein $R^{29}$ is alkyl and alkenyl of from about 1 to about 30 carbon atoms and hydrogen, n is 2 or 3, and m is from about 1 to about 30, and wherein $R^{26}$ is selected from the group consisting of unsubstituted alkyl, alkenyl, aryl, alkaryl and aralkyl of about 1 to about 30 carbon atoms, and substituted alkyl, alkenyl, aryl, alkaryl, and aralkyl of from about 1 to about 30 carbon atoms wherein the substituents are selected from the group consisting of halogen, carboxyl, and hydroxyl, said composition having a melting point of from about 35° C. to about 100° C.

This component can provide the following benefits: superior odor, a decrease in paint softening of the dryer drum, and/or improved fabric conditioning performance, compared to similar articles without this component. Either $R^{24}$, $R^{25}$, $R^{26}$, and/or $R^{27}$ chains can contain unsaturation for improved antistatic benefits.

Tertiary amine salts of carboxylic acids have superior chemical stability, compared to primary and secondary amine carboxylate salts. For example, primary and secondary amine carboxylates tend to form amides when heated, e.g., during processing or use in the dryer. Also, they absorb carbon dioxide, thereby forming high melting carbamates which build up as an undesirable residue on treated fabrics.

Preferably, $R^{24}$ is an aliphatic chain containing from about 12 to about 30 carbon atoms, $R^{25}$ is an aliphatic chain of from about 1 to about 30 carbon atoms, and $R^{25}$ is an aliphatic chain of from about 1 to about 30 carbon atoms. Particularly preferred tertiary mines for static control performance are those containing unsaturation; e.g., oleyldimethylamine and/or soft tallowdimethylamine.

Examples of preferred tertiary amines as starting material for the reaction between the amine and carboxylic acid to form the tertiary amine salts are: lauryldimethylamine, myristyldimethylamine, stearyldimethylamine, tallowdimethylamine, coconutdimethylamine, dilaurylmethylamine, distearylmethylamine, ditallowmethylamine, oleyldimethylamine, dioleylmethylamine, lauryldi(3-hydroxypropyl)amine, stearyldi(2-hydroxyethyl)amine, trilaurylamine, laurylethylmethylamine, and $C_{18}H_{37}N[(OC_2H_4)_{10}OH]_2$.

Preferred fatty acids are those wherein $R^{27}$ is a long chain, unsubstituted alkyl or alkenyl group of from about 8 to about 30 carbon atoms, more preferably from about 11 to about 17 carbon atoms. Examples of specific carboxylic acids as a starting material are: formic acid, acetic acid, lauric acid, myristic acid, palmitic acid, stearic acid, oleic acid, oxalic acid, adipic acid, 12-hydroxystearic acid, benzoic acid, 4-hydroxybenzoic acid, 3-chlorobenzoic acid, 4-nitrobenzoic acid, 4-ethylbenzoic acid, 4-(2-chloroethyl) benzoic acid, phenylacetic acid, (4-chlorophenyl)acetic acid, (4-hydroxyphenyl)acetic acid, and phthalic acid.

Preferred carboxylic acids are stearic, oleic, lauric, myristic, palmitic, and mixtures thereof.

The amine salt can be formed by a simple addition reaction, well known in the art, disclosed in U.S. Pat. No. 4,237,155, Kardouche, issued Dec. 2, 1980. Excessive levels of free amines may result in odor problems, and generally free amines provide poorer softening performance than the amine salts.

Preferred amine salts for use herein are those wherein the amine moiety is a $C_8$–$C_{30}$ alkyl or alkenyl dimethyl amine or a di-$C_8$–$C_{30}$ alkyl or alkenyl methyl amine, and the acid moiety is a $C_8$–$C_{30}$ alkyl or alkenyl monocarboxylic acid. The amine and the acid, respectively, used to form the amine salt will often be of mixed chain lengths rather than single chain lengths, since these materials are normally derived from natural fats and oils, or synthetic processed which produce a mixture of chain lengths. Also, it is often desirable to utilize mixtures of different chain lengths in order to modify the physical or performance characteristics of the softening composition.

Specific preferred amine salts for use in the present invention are oleyldimethylamine stearate, stearyldimethylamine stearate, stearyldimethylamine myristate, stearyldimethylamine palmitate, distearylmethylamine palmitate, distearylmethylamine laurate, and mixtures thereof. A particularly preferred mixture is oleyldimethylamine stearate and distearylmethylamine myristate, in a ratio of 1:10 to 10:1, preferably about 1:1.

4. Mixtures Thereof

The fabric conditioning compound can be any mixture of the above described conditioning actives.

(E) SUBSTRATE ARTICLES

The present invention encompasses articles of manufacture. Representative articles are those that are adapted to soften fabrics in an automatic laundry dryer, of the types disclosed in U.S. Pat. Nos.: 3,989,631 Marsan, issued Nov. 2, 1976; 4,055,248, Marsan, issued Oct. 25, 1977; 4,073,996, Bedenk et al., issued Feb. 14, 1978; 4,022,938, Zaki et al., issued May 10, 1977; 4,764,289, Trinh, issued Aug. 16, 1988; 4,808,086, Evans et al., issued Feb. 28,1989; 4,103,047, Zaki et al., issued Jul. 25, 1978; 3,736,668, Dillarstone, issued Jun. 5, 1973; 3,701,202, Compa et al., issued Oct. 31,1972; 3,634,947, Furgal, issued Jan. 18, 1972; 3,633,538, Hoeflin, issued Jan. 11, 1972; and 3,435,537, Rumsey, issued Apr. 1, 1969; and 4,000,340, Murphy et al., issued Dec. 28, 1976, all of said patents being incorporated herein by reference.

In a preferred substrate article embodiment, the fabric treatment compositions are provided as an article of manufacture in combination with a dispensing means such as a flexible substrate which effectively releases the composition in an automatic laundry (clothes) dryer. Such dispensing means can be designed for single usage or for multiple uses. The dispensing means can also be a "carrier material" that releases the fabric softener composition and then is dispersed and/or exhausted from the dryer.

The dispensing means will normally carry an effective amount of fabric treatment composition. Such effective amount typically provides sufficient fabric conditioning/antistatic agent and/or anionic polymeric soil release agent for at least one treatment of a minimum load in an automatic laundry dryer. Amounts of fabric treatment composition for multiple uses, e.g., up to about 30, can be used. Typical amounts for a single article can vary from about 0.25 g to about 100 g, preferably from about 0.5 g to about 20 g, most preferably from about 1 g to about 10 g.

Highly preferred paper, woven or nonwoven "absorbent" substrates useful herein are fully disclosed in U.S. Pat. No. 3,686,025, Morton, issued Aug. 22, 1972, incorporated herein by reference. It is known that most substrates are able to absorb a liquid substance to some degree; however, the term "absorbent" as used herein, is intended to mean a substance with an absorbent capacity (i.e., a parameter representing a substrate's ability to take up and retain a liquid) from 4 to 12, preferably 5 to 7, times its weight of water.

Another article comprises a sponge material releasably enclosing enough fabric treatment composition to effectively impart sun-fade protection, fabric soil release, antistatic effect and/or softness benefits during several cycles of clothes. This multi-use article can be made by filling a hollow sponge with about 20 grams of the fabric treatment composition.

Typically the substrate deposits from about 0.05 mg/g to about 2 mg/g of sun-fade protection active onto fabrics.

Especially preferred dryer sheet compositions and substrates are described in P&G copending application Ser. No. 08/102,910, Borcher, Corona, Sturdivant, Sung, And Wojcik, filed Aug. 6, 1993, entitled, "Dryer-Activated Fabric Conditioning Compositions Containing Ethoxylated/Propoxylated Suger Derivatives," which is herein incorporated by reference.

(F) OPTIONAL INGREDIENTS

Well known optional components included in fabric conditioning compositions are narrated in U.S. Pat. No. 4,103,047, Zaki et at., issued Jul. 25, 1978, for "Fabric Treatment Compositions," incorporated herein by reference.

1. Optional Nonionic Softener

A highly preferred optional ingredient is a nonionic fabric conditioning agent/material. Typically, such nonionic fabric softener materials have an HLB of from about 2 to about 9, more typically from about 3 to about 7. In general, the materials selected should be relatively crystalline, higher melting, (e.g., >25° C.).

The level of optional nonionic softener in the solid composition is typically from about 5% to about 25%, preferably from about 10% to about 20%.

Preferred nonionic softeners are fatty acid partial esters of polyhydric alcohols, or anhydrides thereof, wherein the alcohol, or anhydride, contains from about 2 to about 18, preferably from about 2 to about 8, carbon atoms, and each fatty acid moiety contains from about 8 to about 30, preferably from about 16 to about 20, carbon atoms. Typically, such softeners contain from about one to about 3, preferably about 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. These nonionic fabric conditioning materials do not include the ethoxylated sugar derivatives disclosed hereinbefore. They typically contain no more than about 4 ethoxy groups per molecule.

The fatty acid portion of the ester is normally derived from fatty acids having from about 8 to about 30, preferably from about 16 to about 20, carbon atoms. Typical examples of said fatty acids being lauric acid, myristic acid, palmitic acid, stearic acid, oleic acid, and behenic acid.

Highly preferred optional nonionic softening agents for use in the present invention are $C_{10}$–$C_{26}$ acyl sorbitan esters and polyglycerol monostearate. Sorbitan esters are esterified dehydration products of sorbitol. The preferred sorbitan ester comprises a member selected from the group consisting of $C_{10}$–$C_{26}$ acyl sorbitan monoesters and $C_{10}$–$C_{26}$ acyl sorbitan diesters and ethoxylates of said esters wherein one or more of the unesterified hydroxyl groups in said esters contain from 1 to about 4 oxyethylene units, and mixtures thereof. For the purpose of the present invention, sorbitan esters containing unsaturation (e.g., sorbitan monooleate) are preferred.

Sorbitol, which is typically prepared by the catalytic hydrogenation of glucose, can be dehydrated in well known fashion to form mixtures of 1,4- and 1,5-sorbitol anhydrides and small amounts of isosorbides. (See U.S. Pat. No. 2,322,821, Brown, issued Jun. 29, 1943, incorporated herein by reference.)

The foregoing types of complex mixtures of anhydrides of sorbitol are collectively referred to herein as "sorbitan." It will be recognized that this "sorbitan" mixture will also contain some free, uncyclized sorbitol.

The preferred sorbitan softening agents of the type employed herein can be prepared by esterifying the "sorbitan" mixture with a fatty acyl group in standard fashion, e.g., by reaction with a fatty acid halide, fatty acid ester, and/or fatty acid. The esterification reaction can occur at any of the available hydroxyl groups, and various mono-, di-, etc., esters can be prepared. In fact, mixtures of mono-, di-, tri-, etc., esters almost always result from such reactions, and the stoichiometric ratios of the reactants can be simply adjusted to favor the desired reaction product.

For commercial production of the sorbitan ester materials, etherification and esterification are generally accomplished in the same processing step by reacting sorbitol directly with fatty acids. Such a method of sorbitan ester preparation is described more fully in MacDonald; "Emulsifiers:" Processing and Quality Control:, *Journal of the American Oil Chemists' Society,* Vol. 45, October 1968.

Details, including formula, of the preferred sorbitan esters can be found in U.S. Pat. No. 4,128,484, incorporated hereinbefore by reference.

For the purposes of the present invention, it is preferred that a significant mount of di- and tri- sorbitan esters are present in the ester mixture. Ester mixtures having from 20–50% mono-ester, 25–50% di-ester and 10–35% of tri- and tetra-esters are preferred.

The material which is sold commercially as sorbitan mono-ester (e.g., monostearate) does in fact contain significant amounts of di- and tri-esters and a typical analysis of commercial sorbitan monostearate indicates that it comprises about 27% mono-, 32% di- and 30% tri- and tetra-esters. Commercial sorbitan monostearate therefore is a preferred material. Mixtures of sorbitan stearate and sorbitan palmitate having stearate/palmitate weight ratios varying between 10:1 and 1:10, and 1,5-sorbitan esters are useful. Both the 1,4- and 1,5-sorbitan esters are useful herein.

Other useful alkyl sorbitan esters for use in the softening compositions herein include sorbitan monolaurate, sorbitan monomyristate, sorbitan monopalmitate, sorbitan monobehenate, sorbitan monooleate, sorbitan dilaurate, sorbitan dimyristate, sorbitan dipalmitate, sorbitan distearate, sorbitan dibehenate, sorbitan dioleate, and mixtures thereof, and mixed tallowalkyl sorbitan mono- and di-esters. Such mixtures are readily prepared by reacting the foregoing hydroxy-substituted sorbitans, particularly the 1,4- and 1,5-sorbitans, with the corresponding acid or acid chloride in a simple esterification reaction. It is to be recognized, of course, that commercial materials prepared in this manner will comprise mixtures usually containing minor proportions of uncyclized sorbitol, fatty acids, polymers, isosorbide structures, and the like. In the present invention, it is preferred that such impurities are present at as low a level as possible.

The preferred sorbitan esters employed herein can contain up to about 15% by weight of esters of the $C_{20}$–$C_{26}$, and higher, fatty acids, as well as minor mounts of $C_8$, and lower, fatty esters.

Glycerol and polyglycerol esters, especially glycerol, diglycerol, triglycerol, and polyglycerol mono- and/or di-esters, preferably mono-, are also preferred herein (e.g., polyglycerol monostearate with a trade name of Radiasurf 7248). Glycerol esters can be prepared from naturally occurring triglycerides by normal extraction, purification and/or interesterification processes or by esterification processes of the type set forth hereinbefore for sorbitan esters. Partial esters of glycerin can also be ethoxylated with no more than about 4 ethoxy groups per molecule to form usable derivatives that are included within the term "glycerol esters."

Useful glycerol and polyglycerol esters include mono-esters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described hereinbefore for the sorbitan and glycerol esters.

2. Optional Soil Release Agent

Optionally, the compositions herein contain from 0% to about 10%, preferably from about 0.1% to about 5%, more preferably from about 0.1% to about 2%, of a soil release agent. Preferably, such a soil release agent is a polymer. Polymeric soil release agents useful in the present invention include copolymeric blocks of terephthalate and polyethylene oxide or polypropylene oxide, and the like. U.S. Pat. No. 4,956,447, Gosselink/Hardy/Trinh, issued Sep. 11, 1990, discloses specific preferred soil release agents comprising cationic functionalities, said patent being incorporated herein by reference.

A preferred soil release agent is a copolymer having blocks of terephthalate and polyethylene oxide. More specifically, these polymers are comprised of repeating units of ethylene and/or propylene terephthalate and polyethylene oxide terephthalate at a molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

U.S. Pat. No. 4,976,879, Maldonado/Trinh/Gosselink, issued Dec. 11, 1990, discloses specific preferred soil release agents which can also provide improved antistat benefit, said patent being incorporated herein by reference.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon® 4780 (from DuPont) and Milease® T (from ICI).

A more complete disclosure of these highly preferred soil release agents is contained in European Pat. Application 185,427, Gosselink, published Jun. 25, 1986, incorporated herein by reference.

3. Cyclodextrin/Perfume Complexes and Free Perfume

The products herein can also contain from about 0.5% to about 60%, preferably from about 1% to about 50%, cyclodextrin/perfume inclusion complexes, as disclosed in U.S. Pat. Nos. 5,139,687, Borcher et at., issued Aug. 18, 1992; and 5,234,610, Gardlik et at., issued Aug. 10, 1993, which are incorporated herein by reference. Perfumes are highly desirable, can usually benefit from protection, and can be complexed with cyclodextrin. Fabric conditioning products typically contain perfume to provide an olfactory aesthetic benefit and/or to serve as a signal that the product is effective.

The perfume ingredients and compositions of this invention are the conventional ones known in the art. Selection of any perfume component, or amount of perfume, is based solely on aesthetic considerations. Suitable perfume compounds and compositions can be found in the art including U.S. Pat. Nos.: 4,145,184, Brain and Cummins, issued Mar. 20, 1979; 4,209,417, Whyte, issued Jun. 24, 1980; 4,515,705, Moeddel, issued May 7, 1985; and 4,152,272, Young, issued May 1, 1979, all of said patents being incorporated herein by reference. Many of the art recognized perfume compositions are relatively substantive, as described hereinafter, to maximize their odor effect on substrates. However, it is a special advantage of perfume delivery via the perfume/cyclodextrin complexes that nonsubstantive perfumes are also effective. The volatility and substantivity of perfumes is disclosed in U.S. Pat. No. 5,234,610, supra.

If a product contains both free and complexed perfume, the escaped perfume from the complex contributes to the overall perfume odor intensity, giving rise to a longer lasting perfume odor impression.

As disclosed in U.S. Pat. No. 5,234,610, supra, by adjusting the levels of free perfume and perfume/CD complex it is possible to provide a wide range of unique perfume profiles in terms of timing (release) and/or perfume identity (character). Solid, dryer-activated fabric conditioning compositions are a uniquely desirable way to apply the cyclodextrins, since they are applied at the very end of a fabric treatment regimen when the fabric is clean and when there are almost no additional treatments that can remove the cyclodextrin.

4. Other Optional Ingredients

The present invention can include other optional components (minor components) conventionally used in textile treatment compositions, for example, colorants, preservatives, optical brighteners, opacifiers, physical stabilizers such as guar gum and polyethylene glycol, anti-shrinkage agents, anti-wrinkle agents, fabric crisping agents, spotting agents, germicides, fungicides, anti-corrosion agents, antifoam agents, and the like.

(G) USAGE

The substrate embodiment of this invention can be used for imparting the above-described fabric treatment to fabric to provide sun-fade protection, softening and/or antistatic effects to fabric in an automatic laundry dryer. Generally, the method of using the composition of the present invention comprises: commingling pieces of damp fabric by tumbling said fabric under heat in an automatic clothes dryer with an effective amount of the fabric treatment composition. At least the continuous phase of said composition has a melting point greater than about 35° C. and the composition is flowable at dryer operating temperature. This composition comprises from about 10% to about 95%, preferably from about 15% to about 85%, more preferably from about 25% to about 75% of the above-defined fabric conditioning compound, and from about 5% to about 75%, preferably from about 15% to about 60%, more preferably from about 25% to about 60% of the above described sun-fade protection actives.

All percentages, ratios, and parts herein, in the Specification, Examples, and Claims, are by weight and approximations unless otherwise stated.

EXAMPLES I to VII

The following examples further describe and demonstrate embodiments within the scope of the present invention. The examples are given solely for the purpose of illustration and are not to be construed as limitations of the present invention, as many variations thereof are possible without departing from the spirit and scope of the invention.

Example I and II

| Component | I Wt. % | II Wt. % |
|---|---|---|
| Conditioning Compound[1] | 27% | 27% |
| Antioxidant Compound[2] | 36% | 18% |
| Tinuvin ® 328[3] | — | 18% |
| Conditioning Compound[5] | 37% | 37% |

[1]Di-(Oleyloxyethyl)-Di-Methyl Ammonium Methylsulfate
[2]2-(N-methyl-N-cocoamino)ethyl 3',5'-di-tert-butyl-4'-hydroxybenzoate
[3]2-(2'-Hydroxy-3',5'di-tert-amylphenyl) benzotriazole
[5]1:2 ratio of stearyldimethylamine: triple pressed stearic acid

Method of Making Dryer Sheet with Antioxidant Compound as the Sun-Fade Protection Active of Example I Di-(Oleyloxyethyl)-Di-Methyl Ammonium Methylsulfate in the amount of about 12.54 g, stearic acid salt of dimethyl stearyl amine in the amount of about 17.67 g and 2-(N-methyl-N-cocoamino)ethyl 3',5'-di-tert-butyl-4'-hydroxybenzoate in the amount of about 17.29 g are co-melted in an oven heated to about 95° C. until the melt is homogeneous. A polyester sheet substrate of about 1 g in weight is placed on a metal plate heated over a boiling water bath and treated with about 2.50 g of the co-melt. The co-melt is spread evenly over the sheet using a small metal roller. The impregnated sheet is then removed from the heated plate and allowed to cool to room temperature.

Method of Making Dryer Sheet with a Mixture of Antioxidant Compound and Sunscreen Compound as the Sun-Fade Protection Active of Example II Di-(Oleyloxyethyl)-Di-Methyl Ammonium Methylsulfate in the amount of about 12.54 g, stearic acid salt of dimethyl stearylamine in the amount of about 17.67 g, 2-(N-methyl-N-cocoamino)ethyl 3',5'-di-tert-butyl-4'-hydroxybenzoate in the amount of about 8.74 g and Tinuvin® 328 in the amount of about 8.74 g are co-melted in an oven heated to about 95° C. until the melt is homogeneous. A polyester sheet substrate of about 1 g in weight is placed on a metal plate heated over a boiling water bath and treated with about 2.50 g of the co-melt. The co-melt is spread evenly over the sheet using a small metal roller. The impregnated sheet is then removed from the heated plate and allowed to cool to room temperature.

Examples III and IV

| Component | III Wt % | IV Wt % |
|---|---|---|
| DTDMAMS[4] | 10.5 | — |
| Conditioning Compound[5] | 16.5 | 21.1 |
| DEQA[6] | — | 14.2 |
| Glycosperse ® S-20[7] | — | 14.2 |
| Antioxidant Compound[2] | 33.7 | — |
| Tinuvin ® 571[8] | 16.8 | 17.5 |
| Irganox ® 1076[9] | — | 12.5 |
| Clay | 2 | 3.2 |
| Perfume/Cyclodextrin Complex | 19 | 16 |
| Perfume | 1.5 | 1.3 |

[2]Same as above
[4]Di-tallow di-methyl ammonium methyl sulfate
[5]Same as above
[6]hydroxyethyl methyl, di (soft tallowyloxy ethyl) ammonium methyl sulfate
[7]polyethoxylated sorbitan monostearate, available from Lonza
[8]2-(2'hydroxy, 3'dodecyl 5'-methyl phenyl) benzotriazole available from Ciba-Geigy
[9]Octadecyl 3.5 di-tert-buty-4-hydroxy-hydrocinnamate, available from Ciba-Geigy Method of Making Example III DTDMAMS in the amount of about 4.99 g, about 7.84 g of a 1:2 ratio of stearyldimethylamine: triple pressed stearic acid, about 16.00 g of 2-(N-methyl-N-cocoamino)ethyl 3',5'-di-tert-butyl-4'-hydroxybenzoate, about 7.98 g of Tinuvin® 571, and about 0.95 g of Clay are combined and heated in an oven at 95° C. until the mixture is homogeneous. Perfume/Cyclodextrin complex in the amount of about 9.02 g and about 0.71 g free perfume are subsequently blended into the mixture. A polyester substrate of about 1 g in weight is placed on a metal plate heated over a boiling water bath and treated with about 2.5 g of the co-melt. The co-melt is spread evenly over the sheet using a small metal roller. The impregnated sheet is then removed from the heated plate and allowed to cool to room temperature.

Method of Making Example IV

A 1:2 ratio of stearyldimethylamine: triple pressed stearic acid in the amount of about 10.02 g, about 6.75 g each of hydroxyethyl methyl, di (soft tallowyloxy ethyl) ammonium methylsulfate and Glycosperse® S-20, 8.31 g of Tinuvin® 571, and about 1.52 g of Clay are combined and heated in an oven at 95° C. until the mixture is homogeneous. Perfume/cyclodextrin complex in the amount of about 7.60 g and about 0.62 g of free perfume are subsequently blended into the mixture. A polyester substrate of about 1 g in weight is placed on a metal plate heated over a boiling water bath and treated with about 2.5 g of the co-melt. The co-melt is spread evenly over the sheet using a small metal roller. The impregnated sheet is then removed from the heated plate and allowed to cool to room temperature.

Example V

| Component | Wt % |
|---|---|
| Conditioning Compound[5] | 23.2 |
| Conditioning Compound[1] | 16.3 |
| Sorbitan Monooleate | 14.8 |
| Clay | 4.1 |
| Perfume | 1.6 |
| Tinuvin 328[3] | 13.3 |
| Antioxidant Compound[2] | 26.7 |

[1]Same as above
[2]Same as above
[3]Same as above
[5]Same as above

Method of Making Example V

A 1:2 ratio of stearyldimethylamine: triple pressed stearic acid in the amount of about 11.02 g, about 7.74 g of Di-(Oleyloxyethyl)-Di-Methyl Ammonium Methylsulfate, about 7.03 g of Sorbitan Monooleate, about 6.32 g of Tinuvin® 328, about 12.68 g of 2-(N-methyl-N-cocoamino) ethyl 3',5'-di-tert-butyl-4'-hydroxybenzoate, and about 1.95 g of Clay are combined and heated in an oven at about 95° C. until the mixture is homogeneous. Perfume in the amount of about 0.76 g is subsequently blended into the mixture. A polyester substrate of about 1 g in weight is placed on a metal plate heated over a boiling water bath and treated with about 2.5 g of the co-melt. The co-melt is spread evenly over the sheet using a small metal roller. The impregnated sheet is then removed from the heated plate and allowed to cool to room temperature.

| | Example | | |
|---|---|---|---|
| Component | VI Wt. % | VII Wt. % | VII Wt. % |
| Conditioning Compound[1] | 30.0 | 30.0 | — |
| DEQA[6] | — | — | 14.2 |
| Conditioning Compound[5] | 35.0 | 35.0 | 21.1 |
| Glycosperse S-20[7] | — | — | 14.2 |
| Tinuvin 571[8] | 33.7 | — | 30.0 |
| Spectra-Sorb UV-9[10] | | 33.7 | — |
| Perfume | 1.3 | 1.3 | 1.3 |
| Perfume/Cyclodextrin Complex | — | — | 16.0 |
| Clay | — | — | 3.2 |

[1]same as above
[5]same as above
[6]same as above
[7]same as above
[8]same as above
[9]same as above
[10]2-hydroxy-4-methoxy benzophenone, available from American Cyanamide.

Method of Making Examples VI and VII

Di-(Oleyloxyethyl)-Di-Methyl Ammonium Methylsulfate in the amount of about 14.25 g, about 16.62 g of a 1:2 ratio of stearyldimethylamine: triple pressed stearic acid and about 16.01 g of Tinuvin® 571 in example VI and Spectra-Sorb® UV-9 for Example VII, are combined and heated in an oven at about 95° C. until the mixture is homogeneous. Perfume in the amount of about 0.62 g is subsequently blended into the mixture. A polyester substrate of about 1 g in weight is placed on a metal plate heated over a boiling water bath and treated with about 2.5 g of the co-melt. The co-melt is spread evenly over the sheet using a small metal roller. The impregnated sheet is then removed from the heated plate and allowed to cool to room temperature.

Method of Making Example VIII

A 1:2 ratio of stearyldimethylamine: triple pressed stearic acid, in the amount of about 10.02 g, 6.75 g each of hydroxyethyl methyl, di (soft tallowyloxy ethyl) ammonium methylsulfate, and Glycosperse® S-20, about 14.25 g of Tinuvin® 571, and about 1.52 g of Clay are combinee and heated in an oven at about 95° C. until the mixture is homogeneous. Pefume/cyclodextrin complex in the amount of about 7.60 g and about 0.62 g of free perfume are subsequently blended into the mixture. A polyester substrate of about 1 g in weight is placed on a metal plate heated over a boiling water bath and treated with about 2.5 g of the co-melt. The co-melt is spread evenly over the sheet using a small metal roller. The impregnated sheet is then removed from the heated plate and allowed to cool to room temperature.

What is claimed is:

1. An article of manufacture comprising:

I. a composition comprising:

A. from about 5% to about 75%, by weight of the composition, of a non-fabric staining, light stable antioxidant compound having the formula:

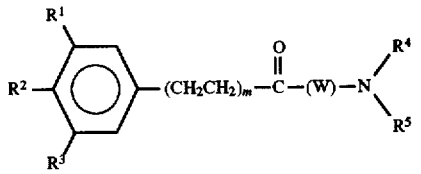

(I)

wherein each $R^1$ and $R^3$ is independently selected from the group consisting of hydroxy, $C_1$ to $C_6$ alkoxy groups, and branched or straight chained $C_1$ to $C_6$ alkyl groups;

each $R^2$ is a hydroxy group;

each $R^4$ is a saturated or unsaturated $C_1$ to $C_{22}$ alkyl group or hydrogen;

each $R^5$ is a saturated or unsaturated $C_1$ to $C_{22}$ alkyl group which can contain ethoxylated or propoxylated groups;

each W is

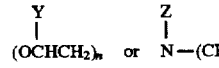

wherein Y is hydrogen or a $C_1$ to $C_5$ alkyl group;

wherein Z is hydrogen, a $C_1$ to $C_3$ alkyl group, which may be interrupted by an ester, amide, or ether group, or a $C_1$ to $C_{30}$ alkoxy group, which may be interrupted by an ester, amide, or ether group;

each m is from 0 to 4;

each n is from 1 to 50;

each q is from 1 to 10;

wherein the antioxidant compound also comprises quaternary ammonium compounds; and B. from about 10% to 95% by weight of the composition of a fabric softening composition selected from the group consisting of:

1. a quaternary ammonium compound;

2. a carboxylic acid salt of a tertiary amine;

3. a fabric softening compound having the formula:

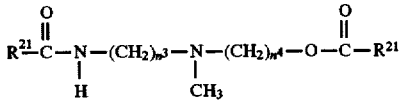

wherein each $R^{21}$ is independently a $C_{11}$ to $C_{31}$ hydrocarbyl group;

$n^3$ is from 1 to 5; and $n^4$ is from 1 to 5; and 4. mixtures thereof;

wherein the quaternary ammonium compound is selected from the group consisting of:

$$[(R^{17})_{4-p}N^+-[(CH_2)_v-Y'-R^{18}]_p]X^-; \qquad \text{Formula I}$$

wherein each Y' is —O—(O)C— or —C(O)—O—;

p is 1 to 3;

each v is an integer from 1 to 4;

each $R^{17}$ substituent is a short chain $C_1$ to $C_6$ alkyl group;

each $R^{18}$ is $C_8$ to $C_{30}$ hydrocarbyl or substituted hydrocarbyl substituent; and the counterion, $X^-$, can be any softener-compatible anion;

Formula II

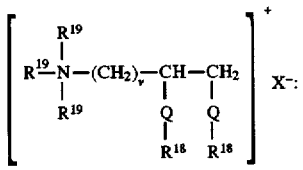

wherein each Q is

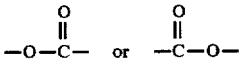

each $R^{19}$ is $C_1$ to $C_4$ alkyl or hydroxy alkyl group;

each $R^{18}$, v, and X— are defined hereinbefore for Formula I;

Formula III

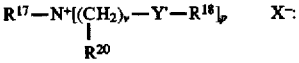

wherein $R^{20}$ is a short chain $C_1$ to $C_4$ alcohol;

p is 2;

$R^{17}$, $R^{18}$, v, Y', and $X^-$ are defined hereinbefore for Formula I;

Formula IV: $(R^{17})_{4-p}-N^+-[(CH_2)_v-Y''-R^{18}]_p\ X^-$ wherein $R^{17}$, $R^{18}$, p, v, and $X^-$ are defined hereinbefore for Formula I; and Y" is

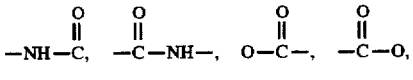

or mixtures thereof;

wherein at least one Y" group is $$-NH-\overset{O}{\overset{\|}{C}} \quad \text{or} \quad -\overset{O}{\overset{\|}{C}}-NH-;$$

and wherein the composition optionally includes a non-fabric staining, light stable sunscreen compound; and II. a substrate, on which said composition is attached, which provides for release of an effective amount of said composition onto fabrics in an automatic laundry dryer at automatic laundry dryer operating temperatures;

wherein said antioxidant compound is a solid having a melting point of less than about 80° C., or a liquid at a temperature of less than about 40° C.; and wherein said optional sunscreen compound absorbs light at a wavelength of from about 290 nm to about 450 nm and is a solid compound having a melting point of from about 25° C. to about 90° C., or a viscous liquid at a temperature of 0° C. to about 25° C.

2. The article of manufacture of claim 1 wherein said substrate is a flexible substrate which releases said composition in an automatic laundry dryer.

3. The article of manufacture of claim 2 wherein said substrate can deposit from about 0.05 mg/g to about 2 mg/g of antioxidant onto fabric.

4. The article of manufacture of claim 1 wherein said fabric conditioning compound is present at a level of from about 15% to about 60% by weight of the composition.

5. The article of manufacture of claim 4 wherein said fabric conditioning compound is present at a level of from about 25% to about 75%, by weight of the composition.

6. The article of manufacture of claim 1 wherein said quaternary ammonium compound is a fully saturated Formula I compound.

7. The article of manufacture of claim 6 wherein said Formula I compound is dimethyl bis(soft tallowyl oxyethyl) ammonium methyl sulfate.

8. The article of manufacture of claim 1 wherein said carboxylic acid salt of a tertiary amine has a carboxylic acid salt forming moiety selected from the group consisting of lauric acid, myristic acid, palmitic acid, stearic acid, oleic acid, and mixtures thereof.

9. The article of manufacture of claim 8 wherein said carboxylic acid salt of a tertiary amine is selected from the group consisting of oleyldimethylamine stearate, dioleylmethylamine stearate, linoleyldimethylamine stearate, dilinoleylmethylamine stearate, stearyldimethylamine stearate, distearylmethylamine palmitate, distearylmethylamine myristate, distearylmethylamine laurate, dioleyldistearylmethylamine oleate, distearylmethylamine oleate, and mixtures thereof.

10. The article of manufacture of claim 9 wherein said carboxylic acid salt of a tertiary amine comprises a mixture of oleyldimethylamine stearate and distearylmethylamine myristate in a weight ratio of from about 1:10 to about 10:1.

11. The article of manufacture of claim 1 wherein said antioxidant compound is present at a level of from about 15% to about 60%, by weight of the composition.

12. The article of manufacture of claim 11 wherein the level of said antioxidant compound is from about 25% to about 50%, by weight of the composition.

13. The article of manufacture of claim 1 wherein each $R^1$ and $R^3$ are branched $C_1$–$C_6$ alkyl groups; each $R^4$ is a methyl group; each $R^5$ is a saturated or unsaturated alkyl chain having from about 8 to about 22 carbon atoms; each m is from about 0 to about 2; each n is from about 1 to about 10; and each q is from 2 to about 6.

14. The article of manufacture of claim 13 wherein each $R^1$ and $R^3$ are "tert"-butyl groups; each $R^5$ is an alkyl chain having from about 12 to about 14 carbon atoms; and each n is 1.

15. The article of manufacture of claim 1 wherein said antioxidant compound is selected from the group consisting of 2-(N-methyl-N-cocoamino)ethyl 3',5'-di-tert-butyl-4'-hydroxybenzoate; 2-(N, N-dimethyl-amino)ethyl 3',5'-di-tert-butyl-4'-hydroxybenzoate; 2-(N-methyl-N-cocoamino) ethyl 3',4',5'-trihydroxybenzoate; and mixtures thereof.

16. The article of manufacture of claim 15 wherein said antioxidant compound is 2-(N-methyl-N-cocoamino) ethyl-3',5'-di-tert-butyl-4'-hydroxybenzoate.

17. The article of manufacture of claim 1 wherein said optional sunscreen compound has a melting point of from about 25° C. to about 75° C. and is present at a level of from about 15% to about 60% by weight of the composition.

18. The article of manufacture of claim 17 wherein said optional sunscreen compound has a melting point of from about 25° C. to about 50° C. and is present at a level of from about 25% to about 50% by weight of the composition.

19. The article of manufacture of claim 18 wherein said sunscreen compound is selected from the group consisting of:

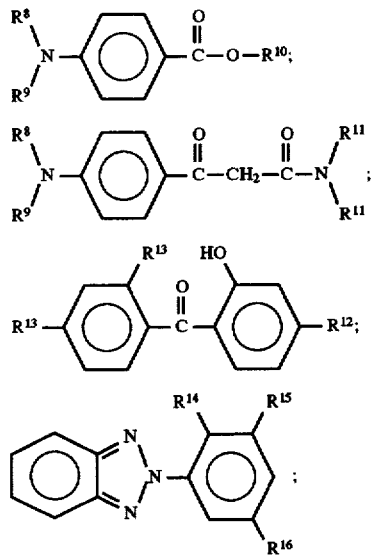

(V)

mixtures thereof;

wherein each $R^8$ is a hydrogen, or a $C_1$ to $C_{22}$ alkyl group;

each $R^9$ is a hydrogen, or a $C_1$ to $C_{22}$ alkyl group;

each $R^{10}$ is a $C_1$ to $C_{22}$ alkyl group;

each $R^{11}$ is a hydrogen, $C_1$ to $C_{22}$ alkyl group and mixtures thereof;

each $R^{12}$ is a hydrogen, hydroxy group, methoxy group, a $C_1$ to $C_{22}$ alkyl group (which can be an ester, amide, or ether interrupted group) and mixtures thereof;

each $R^{13}$ is a hydrogen, hydroxy group, a $C_1$ to $C_{22}$ alkyl group (which can be an ester, amide, or ether interrupted group) and mixtures thereof;

each $R^{14}$ is a hydrogen, hydroxy group, or a $C_1$ to $C_{22}$ alkyl group;

each $R^{15}$ is a hydrogen, hydroxy group, a $C_1$ to $C_{22}$ alkyl group (which can be an ester, amide, or ether interrupted group) and mixtures thereof; and each $R^{16}$ is a hydrogen, hydroxy group, or a $C_1$ to $C_{22}$ alkyl group (which can be an ester, amide, or ether interrupted group).

20. The article of manufacture of claim 19 wherein each $R^8$ is a hydrogen or a methyl group;

each $R^9$ is a hydrogen, or a methyl group;

each $R^{10}$ is a $C_8$ to $C_{18}$ alkyl group;

each R11 is a methyl group, $C_8$ to $C_{22}$ alkyl group, and mixtures thereof, each $R^{12}$ is a $C_1$ to $C_{22}$ alkyl group interrupted by an ether or ester group;

each $R^{13}$ is a hydrogen, hydroxy group, and mixtures thereof, each $R^{14}$ is a hydrogen or hydroxy group;

each $R^{15}$ is a $C_1$ to $C_{12}$ alkyl group; and each $R^{16}$ is a tert-amyl, a methyl phenyl group, or a coco dimethyl butaonate group.

21. The article of manufacture of claim 20 wherein each $R^{10}$ is a $C_{12}$ to $C_{18}$ alkyl group;

one $R^{11}$ is a $C_{12}$ to $C_{18}$ alkyl group and the other $R^{11}$ is a methyl group;

each $R^{12}$ is a $C_8$ to $C_{22}$ alkyl group interrupted by an ester group;

each $R^{13}$ is a hydrogen; and each $R^{15}$ is a methyl group, a "tert"-amyl group, a dodecyl group, and mixtures thereof.

22. The article of manufacture of claim 1 wherein said composition further comprises a mixture of said antioxidant compound and said optional sunscreen compound wherein the ratio of said antioxidant compound to said optional sunscreen compound is from about 1:10 to about 10:1.

23. The article of manufacture of claim 22 wherein the ratio of said antioxidant compound to said optional sunscreen compound is from about 1:5 to about 5:1.

24. The article of manufacture of claim 23 wherein the ratio of said antioxidant compound to said optional sunscreen compound is from about 1:2 to about 2:1.

25. The article of manufacture of claim 24 wherein the composition additionally comprises from about 0% to about 10%, by weight of the composition, of a soil release polymer.

26. The article of manufacture of claim 25 wherein said soil release polymer is at a level of from about 0.1% to about 5%, by weight of the composition.

27. A method of treating fabrics to provide sun fade protection, comprising adding the article of manufacture of claim 1 to an automatic laundry dryer with a bundle of wet fabrics.

* * * * *